US011079075B2

(12) United States Patent
Weyhaeghe

(10) Patent No.: US 11,079,075 B2
(45) Date of Patent: Aug. 3, 2021

(54) CONFIGURABLE AND ADJUSTABLE LUMINAIRE

(71) Applicant: SIGNIFY HOLDING B.V., Eindhoven (NL)

(72) Inventor: Lukas Weyhaeghe, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/651,129

(22) PCT Filed: Sep. 28, 2018

(86) PCT No.: PCT/EP2018/076378
§ 371 (c)(1),
(2) Date: Mar. 26, 2020

(87) PCT Pub. No.: WO2019/068569
PCT Pub. Date: Apr. 11, 2019

(65) Prior Publication Data

US 2020/0232612 A1 Jul. 23, 2020

(30) Foreign Application Priority Data

Oct. 2, 2017 (EP) ..... 17194432
Oct. 3, 2017 (EP) ..... 17194585

(51) Int. Cl.

| | |
|---|---|
| ***F21S 2/00*** | (2016.01) |
| ***F21S 8/02*** | (2006.01) |
| ***F21V 19/02*** | (2006.01) |
| ***F21V 21/04*** | (2006.01) |

(52) U.S. Cl.
CPC ..... *F21S 2/005* (2013.01); *F21S 8/026* (2013.01); *F21V 19/02* (2013.01); *F21V 21/04* (2013.01)

(58) Field of Classification Search
CPC F21S 2/005; F21S 8/026; F21V 19/02; F21V 21/04
USPC ..... 362/249.01
See application file for complete search history.

(56) References Cited

U.S. PATENT DOCUMENTS

| | | | | |
|---|---|---|---|---|
| 3,585,380 | A * | 6/1971 | Friedman | F21V 21/00 362/311.05 |
| 5,660,461 | A | 8/1997 | Ignatius et al. | |
| 5,931,432 | A * | 8/1999 | Herold | H02G 3/123 248/343 |
| 7,431,482 | B1 | 10/2008 | Morgan et al. | |
| 8,210,734 | B2 | 7/2012 | Wu | |
| 2006/0262545 | A1 * | 11/2006 | Piepgras | F21V 29/773 362/373 |

(Continued)

FOREIGN PATENT DOCUMENTS

| | | | |
|---|---|---|---|
| CN | 203686650 | U | 7/2014 |
| GB | 2526144 | A | 11/2015 |

(Continued)

*Primary Examiner* — Bryon T Gyllstrom
(74) *Attorney, Agent, or Firm* — Daniel J. Piotrowski

(57) ABSTRACT

The invention provides a luminaire comprising a housing. The housing carries a lighting unit. The luminaire comprises an annular wall and a radially extending flange portion around the annular wall. The annular wall extending in an axial direction from the radially extending flange portion and at least a portion of the radially extending flange may be removable to allow mechanical connection between adjacent luminaires thus creating a lighting system.

13 Claims, 14 Drawing Sheets

(56) References Cited

U.S. PATENT DOCUMENTS

| | | | | |
|---|---|---|---|---|
| 2008/0068847 | A1 | 3/2008 | Bedard | |
| 2008/0112171 | A1* | 5/2008 | Patti | F21V 21/04 362/365 |
| 2009/0175040 | A1* | 7/2009 | Green | F21V 19/02 362/294 |
| 2009/0237936 | A1* | 9/2009 | Ku | F21V 21/005 362/249.14 |
| 2012/0230030 | A1* | 9/2012 | Miller | F21S 2/005 362/249.01 |
| 2013/0272003 | A1* | 10/2013 | Miletich | F21V 23/007 362/382 |
| 2017/0097144 | A1* | 4/2017 | Owens | F21V 17/06 |
| 2020/0018452 | A1* | 1/2020 | Weyhaeghe | F21V 21/04 |

FOREIGN PATENT DOCUMENTS

| | | | |
|---|---|---|---|
| WO | 201402085 | A1 | 1/2014 |
| WO | 2017072739 | A1 | 5/2017 |

* cited by examiner

CONFIGURABLE AND ADJUSTABLE LUMINAIRE

CROSS-REFERENCE TO PRIOR APPLICATIONS

This application is the U.S. National Phase application under 35 U.S.C. § 371 of International Application No. PCT/EP2018/076378, filed on Sep. 28, 2018, which claims the benefit of European Patent Application No. 17194432.5, filed on Oct. 2, 2017 and European Patent Application No. 17194585.0, filed on Oct. 3, 2017. These applications are hereby incorporated by reference herein.

FIELD OF THE INVENTION

This invention relates to a luminaire, in particular with a late stage configurable housing.

BACKGROUND OF THE INVENTION

Recessed luminaires are used to create flush lighting units in a sheet or concrete structure, such as a ceiling. Typically, there is an outer housing which is fixed to the ceiling and an inner part which carries a light engine (for example comprising a light source, an optical element such as a lens and/or reflector, and a heat sink), or else the inner part is just a light engine, which is removable from the outer part to enable replacement of the light engine.

There is a desire to be able to alter the housing of the luminaire in a simple and intuitive way and to create a lighting system in a simple and intuitive way.

There remains a need for a luminaire design which can achieve this function.

SUMMARY OF THE INVENTION

The invention is defined by the claims.

According to examples in accordance with an aspect of the invention, there is provided a luminaire comprising:

a housing having a central axis, and a lighting unit insertable into and removable from the housing, preferably insertable and removable in a direction along the central axis, the housing comprising:

an annular wall around the central axis, and a radially extending flange around the annular wall, wherein the annular wall protrudes in an axial direction from a first main face of the annular flange, and wherein a portion of the flange is removable from the housing.

This luminaire thus allows the installer to create a desired luminaire from at least one housing. If used alone, the housing and lighting unit can create a single lamp recessed luminaire. However, if the installer wishes to make a more complex arrangement he can remove at least part of the radially extending flange from the housing to allow a second housing/luminaire to be connected to the first. It can be seen that a wide range of arrangements of mutually connected luminaires can be made to form a housing/luminaire group. The annular wall forms a cavity in which the lighting unit is to be accommodated.

For example, if a portion of the radially extending flange is removed from a first luminaire and a corresponding portion is removed from the radially extending flange of a second luminaire these two luminaires can be connected to create a luminaire that is suitable for receiving two lighting units, thus creating a two-lamp luminaire. Further additional housings can be added to increase the number of lighting units that can be received and or to increase the diversity of configurations possible.

In an embodiment, a third housing/luminaire can be added between the first and second housings/luminaires by removing at least two portions of the radially extending flange of the third housing and one portion of the radially extending flange from each of the first and third luminaires. These two removed portions of the radially extending flange of the third luminaire may, for example, be opposite each other to create an extended three lamp linear luminaire or they may be adjacent portions allowing the creation of an angled luminaire, for example a 90° L-shaped luminaire. Further housings/luminaires can be added by removal of relevant portions and connecting these further housings/luminaires to the instant housing/luminaire group.

In an embodiment, the luminaire further comprises at least one clamping arrangement for clamping the housing/luminaire to a carrier or substrate. This clamping arrangement may take the form of a bolt with an elongated foot at the distal end. The head of the bolt may be accessed through a hole in the radially extending flange and tightening the bolt will move the elongated foot towards the main face of the radially extending flange. The flange also has a second main face which is opposite to the first main face. The elongated foot will impinge upon a face of a carrier or substrate thus tightening the main face of the radially extending flange against a second face of the carrier or substrate.

In an embodiment, the cross section of the luminaire orthogonal to the central axis is a polygonal shape, a wide variety of polygonal shapes may be suitable for such a luminaire, for example, a circle, an ellipse, a square, a rectangle, a triangle, hexagon or any other polygonal shape. In particular, cross-sectional shapes that can be used to create a tessellated surface are attractive for use in such a luminaire. Circles and ellipses, whilst not strictly able to provide a tessellated surface if we apply the definition of "to tessellate" as "to cover the plane (or surface) with a pattern in such a way as to leave no region uncovered", remain interesting as the overall effect of close packed circles (either in a so called "square-packing" or a "hexagonal packing") is often perceived as a visually appealing pattern. Moreover, a luminaire with a circular cross-section orthogonal to the central axis may be easier to manufacture than a luminaire with a square cross-section orthogonal to the central axis.

In an embodiment, the at least one clamping element is arranged alongside an outer surface of the annular wall. At least one clamping element may be arranged alongside each face of the annular wall or multiple clamping elements may be arranged alongside a single surface of the luminaire. In order to facilitate a closer pitch distance (i.e., the distance between the central axes of connected luminaires) it may be advantageous to remove the at least one clamping arrangement from the luminaire. In the case of connecting two square cross-sectional luminaires having at least one clamping arrangement per face (i.e., four clamping elements per luminaire), a portion of the radially extending flange of the first luminaire is removed, the clamping arrangement on the face closest to the removed portion is removed, a portion of the radially extending flange of the second luminaire is removed, the clamping element on the face closest to the removed portion of the second luminaire is removed and the two luminaires are connected together. In certain embodiments, it is preferable that the at least one clamping arrangement does not extend in a radial direction beyond the radially extending flange.

In an embodiment, the radially extending flange further comprises surface features or through-holes to demarcate at least one cutting line. The method of cutting may be dependent on the thickness of the radially extending flange. If it is relatively thin and/or numerous through-holes are provided along the suggested cutting line then a pair of scissors may suffice to cut the flange. If the radially extending flange has a greater thickness and/or a lesser number of through-holes provided along the suggested cutting line then a pair of pliers may be required to cut through the flange.

In an embodiment, the cross section of the luminaire orthogonal to the central axis is a polygonal shape and each side of the polygonal shape has a respective cutting line. This cutting line may extend adjacent to and/or parallel to the side. The cutting line may extend over the full length of the flange at the respective side. However, the cutting line may also be parallel to the side of the polygonal shape but it may be spaced away from the side of the polygonal shape, for example, the cutting line may be half-way between the side of the polygonal shape and the furthest extremity of the radially extending flange. The cutting line may also only extend across a predetermined distance of the radially extending flange. The cutting line may also be discontinuous along its length.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a luminaire comprising a housing and lighting unit insertable into and removable from the housing. The housing comprises an annular wall around the central axis of the housing and a radially extending flange around the annular wall. The annular wall protrudes in an axial direction from a first main face of the annular flange and a portion of the flange is removable from the housing. This provides a luminaire which can be configured into various different lighting system configurations by connecting luminaires together. Additionally, the annular wall may also protrude in an axial direction from a second main face, opposite to the first main face, of the annular flange. A preferable modular lighting system can be configured, all without needing tools.

The term light engine in this case may for example relate to a set of assembled components such as one or more light sources (incandescent or fluorescent bulb, high intensity discharge lamp, LED, OLED), an optical element (lens, reflector) and a heat sink. The general term "lighting unit" is intended to cover any type of light source, with or without optical elements and with or without a heat sink.

Figure 1B:
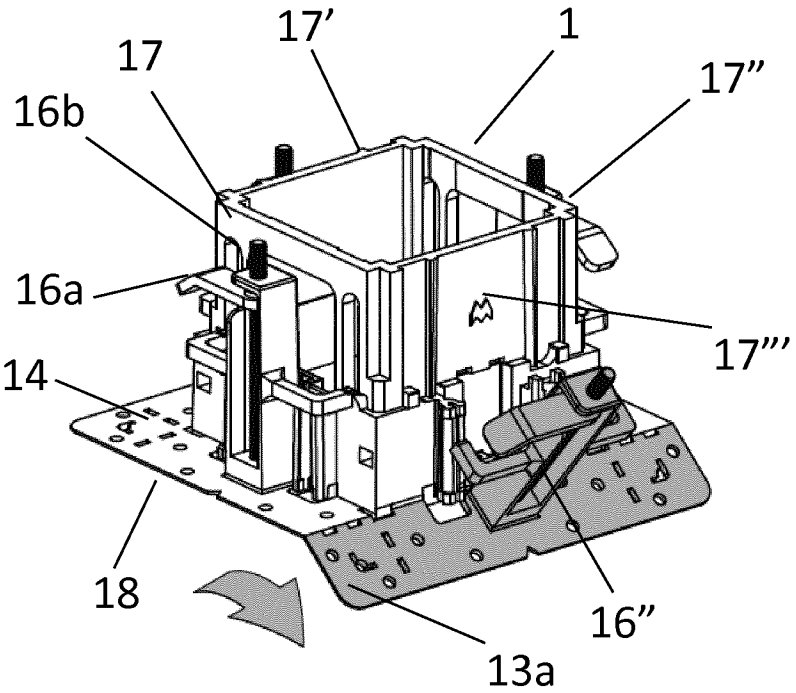
FIG. 1B shows a side view of the first example of the luminaire with a first portion of a radially extending flange being removed.
Figure 1A:
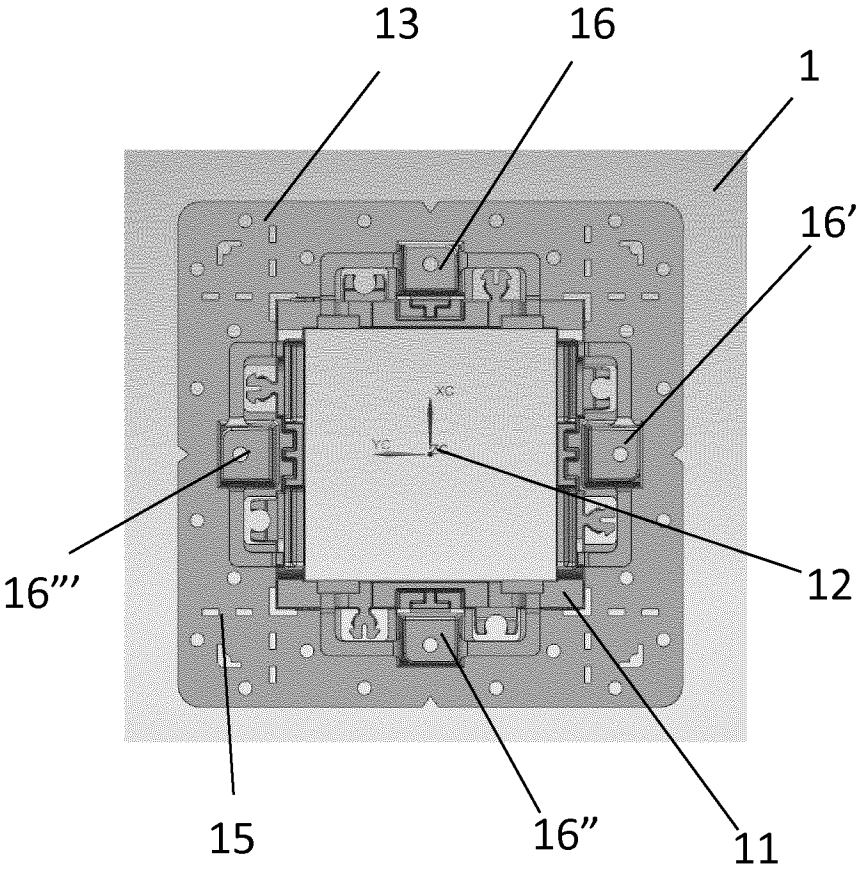
FIG. 1A shows a first example of a luminaire housing, shown in a plan view.

FIG. 1A shows a first example of a luminaire housing 1, the housing has an annular wall 11 surrounding a central axis 12 (shown here as an origin point) and a radially extending flange 13 around the annular wall 11. To connect the luminaire housing 1 to a second luminaire housing 1' or a further luminaire housing 1", the radially extending flange 13 has a portion 13*a* that is removable from the housing. To allow a user or installer to remove the portion, preferably in a quick, easy and safe manner at least one cutting line 15, the at least one cutting line 15 demarcated using surface features or through holes.

In this embodiment at least one clamping element 16, 16', 16" & 16'" are shown per face 17, 17', 17" & 17'" of the polygonal shape (in this embodiment, a square is shown)

that forms the annular wall 11. The at least one clamping element 16, 16', 16" & 16'" is provided for clamping the housing to a carrier or substrate (not shown). This method of attaching the luminaire housing 1 to a desired location is user friendly and may further increase the appeal of the finished lighting system. It can be seen from this element that at least one clamping element 16, 16', 16" & 16'" are provided per face 17, 17', 17" & 17'" of the square cross-sectioned annular wall 11. This is not a necessity as the luminaire housing 1 may remain secured in the desired location with lesser or more clamping elements 16, 16', 16" & 16'". Indeed, the clamping elements 16, 16', 16" & 16'" could be arranged such that multiple clamping elements, for example two, are arranged on two consecutive faces 17, 17', 17" or 17'". In the embodiment shown in FIG. 1*a*, the at least one clamping element 16, 16', 16" & 16'" are shown arranged alongside an outer surface of the 17, 17', 17" & 17'" of the square cross-sectioned annular wall 11 around a cavity 22 in which a lighting unit (not shown) is to be accommodated. Additionally, the at least one clamping element 16, 16', 16" & 16'" do not extend in a radial direction past the radially extending flange 13.

The installation of such a luminaire housing in the desired location may be a simple as selecting a suitable tool for cutting a hole in the carrier or substrate and inserting the housing 1 such that it extends through an opening in the substrate or carrier. The opening may be made into plasterboard, wooden, metallic or concrete material or a combination of these, for ceiling and wall applications.

A hole-saw is commonly used to provide the opening, such a saw is mounted in a drill and then used to cut the substrate or carrier. A suitable size for such a hole-saw is one that has a greater diameter than the distance from the outermost surface of one clamping arrangement 16 to the outer face of a corresponding clamping arrangement 16" located opposite to the first clamping element 16, whilst being of smaller diameter than the overall width of the radially extending flange 13. The radially extending flange 13 will then sit against the carrier or substrate and is larger than the hole provided thus masking the hole that has been cut into the substrate or carrier. The visual appearance of the luminaire housing 1 may be further enhanced by a cover plate if desired (not shown), or as an alternative, the radially extending flange 13 may be recessed into the carrier or substrate such that the radially extending flange 13 is flush with the carrier or substrate.

FIG. 1B shows a side view of the first example of the luminaire 1 with a first portion 13*a* of a radially extending flange 13 being removed. It can also be seen in this embodiment that at least one clamping element 16" is also being removed from the housing 1. In the example shown, an elongated foot 16*a* is located at the distal end of a bolt 16*b*.

The at least one clamping arrangement 16, 16', 16" or 16'" may be considered to be part of the housing 1 (since it forms part of the housing 1) or it may be considered to be a separate part for fixing the (other parts of the) housing 1 to the carrier or substrate.

The head of the bolt 16*b* may be accessed through a hole (not shown) in the radially extending flange 13 and tightening the bolt 16*b* will move the elongated foot 16*a* towards a main face 14 of the radially extending flange 13. The flange 13 also has a second main face 18 which is opposite to the first main face 14. The elongated foot 16*a* will impinge upon a face of a carrier or substrate thus tightening the main face 14 of the radially extending flange 13 against a second face of the carrier or substrate.

In this way, the housing 1 is firmly attached to the carrier or substrate, and this preferably may all be carried out from below the carrier or substrate.

Figure 2B:
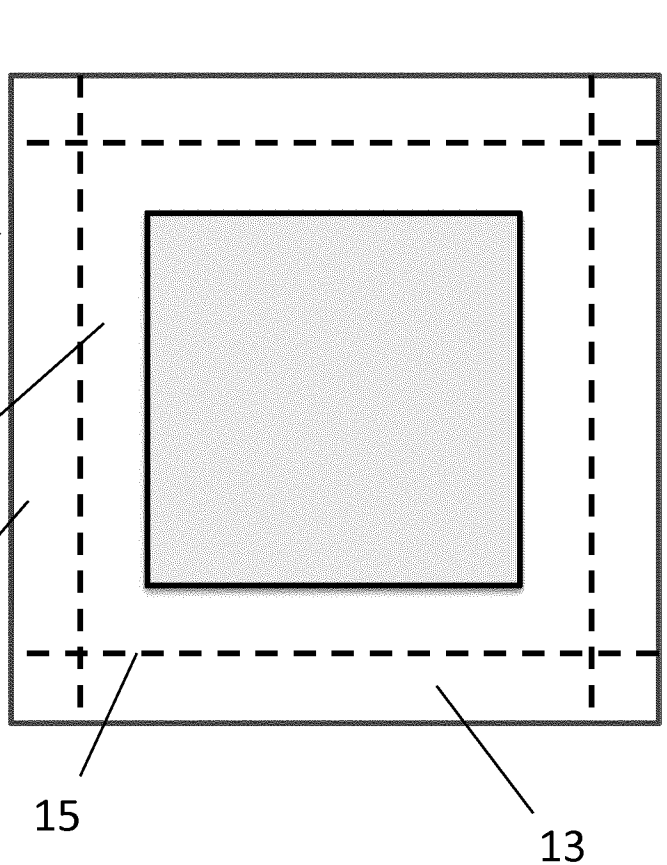
FIG. 2B shows a view from beneath (facing the light output face) of a schematic embodiment of a further luminaire.
Figure 2A:
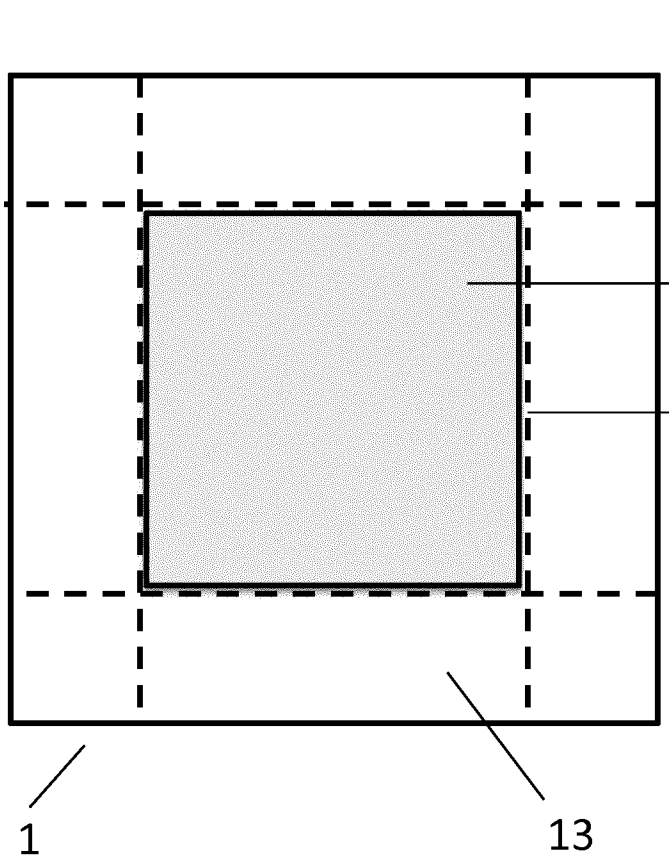
FIG. 2A shows a view from beneath (facing the light output face) of a schematic embodiment of a luminaire.

FIG. 2A shows a view from beneath (facing the second main face 18, also considered to be the light output face) of a schematic embodiment of a luminaire 10. The central region 29 may be the light exit window of the lighting unit. The lighting unit is inserted into housing 1 to complete the luminaire 10. In the example shown, the at least one cutting line 15 extends parallel and adjacent to the side of the square cross-sectioned housing 1. When the portion of the radially extending flange 13 is removed by cutting or bending the flange at the demarcated cutting line, the remaining portion (s) of the radially extending flange 13 end substantially flush with the annular wall 11 of the housing 1. This will allow a closer coupling of luminaires 10, 10' and 10" etc. when constructing a modular lighting system 100 (shown in more details in FIGS. 8B to 11).

FIG. 2B shows a view from beneath (facing the light output face) of a schematic embodiment of a further luminaire. In the embodiment shown, the at least one cutting line 15 extends parallel to the side of the square cross-sectioned housing 1. Unlike the previous embodiment, the at least one cutting line 15 is not adjacent to the side of the square cross-sectioned housing 1. This means that when a portion 13*a* of the radially extending flange is removed, there will be a remaining portion 13*b* of the radially extending flange adjacent to the side of the square cross-sectioned housing 1. This means that when constructing a modular lighting system 100 using multiple luminaires 10, 10', 10' and 10" etc. that there will be a larger distance (pitch) between the centers of the adjacent, connected luminaires 10, 10', 10" etc. than in the embodiment shown in FIG. 2A.

Figure 3B:
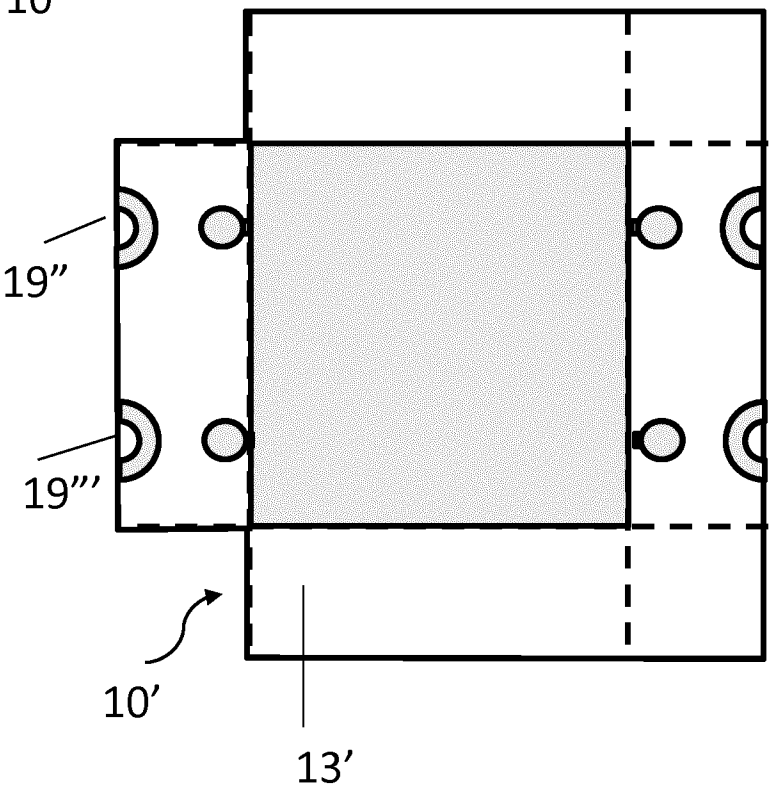
FIG. 3B shows a view from beneath (facing the light output face) of a schematic embodiment of a corresponding further luminaire.
Figure 3A:
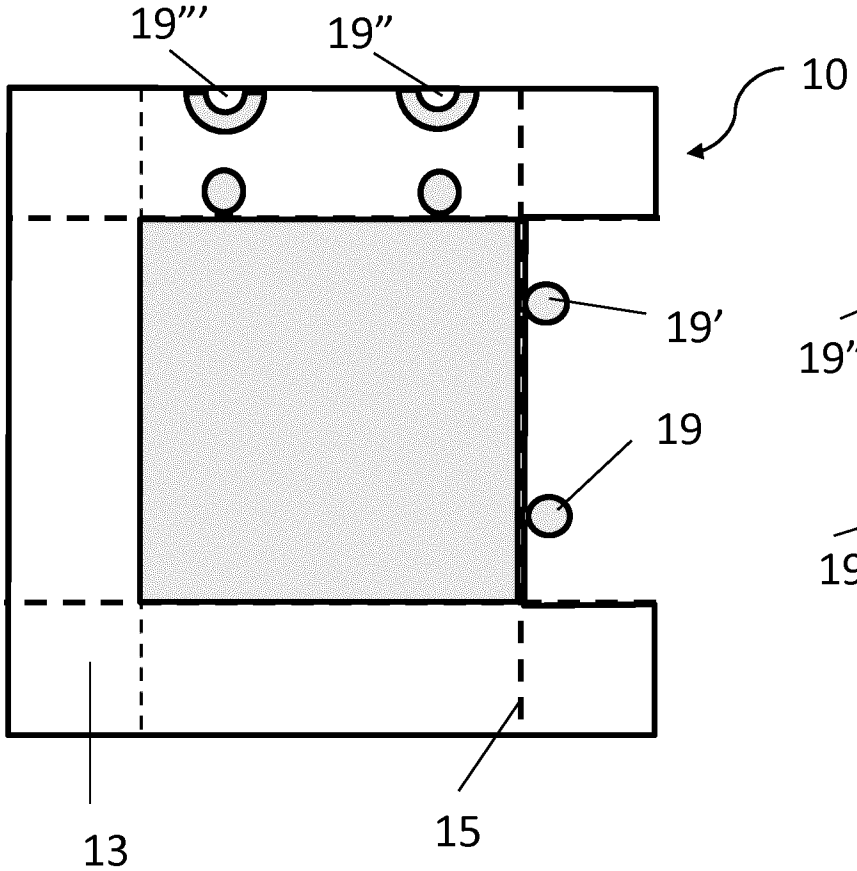
FIG. 3A shows a view from beneath (facing the light output face) of a schematic embodiment of a further luminaire.

FIG. 3A shows a view from beneath (facing the light output face) of a schematic embodiment of a further luminaire 10. In the embodiment shown the at least one cutting line 15 is adjacent and parallel to the face of the annular wall. The annular wall further comprises mechanical connector elements 19 & 19' and the radially extending flange 13 further comprises two mechanical connector elements 19" & 19'". In this embodiment, there are two connector elements shown on a single face of the annular wall, as well as two connectors shown on the radially extending flange. However, other configurations are possible such a single connector element 19 per face or multiple connector elements 19, 19', 19' etc. per face. Furthermore, the mechanical connector elements 19 may be formed as a male connector element, a female connector element, a hermaphroditic connector or a combination of the aforementioned types. The mechanical connection elements 19, 19', 19", 19'" etc. may be located in multiples on a single side and the multiples may be of the same sex, or different sexes, i.e., multiple female connectors on one face, multiple male connectors, multiple hermaphroditic connectors or they may be mixed sex, i.e., combinations of male, female and/or hermaphroditic connectors on the same face. The mechanical connection elements 19, 19', 19", 19'" etc. may be located on the inside of the annular wall or on the outside of the annular wall or a combination thereof. The mechanical connectors may connect the lighting unit to the housing when located on the inner of the annular wall and they may connect a housing to a further housing when located on the outside of the annular wall.

FIG. 3B shows a view from beneath (facing the light output face) of a schematic embodiment of a corresponding further luminaire 10'. It can be seen from FIGS. 3A and 3B that the first luminaire 10 and the further luminaire 10" are designed to cooperate with each other to create a two-lamp lighting system 100. Two portions have been removed from the radially extending flange 13 so that the first flange 13 of the first luminaire 10 and the second flange 13' of the second luminaire 10' are connectable matching parts, which in a mutually connected position form a shared flange.

Figure 4B:
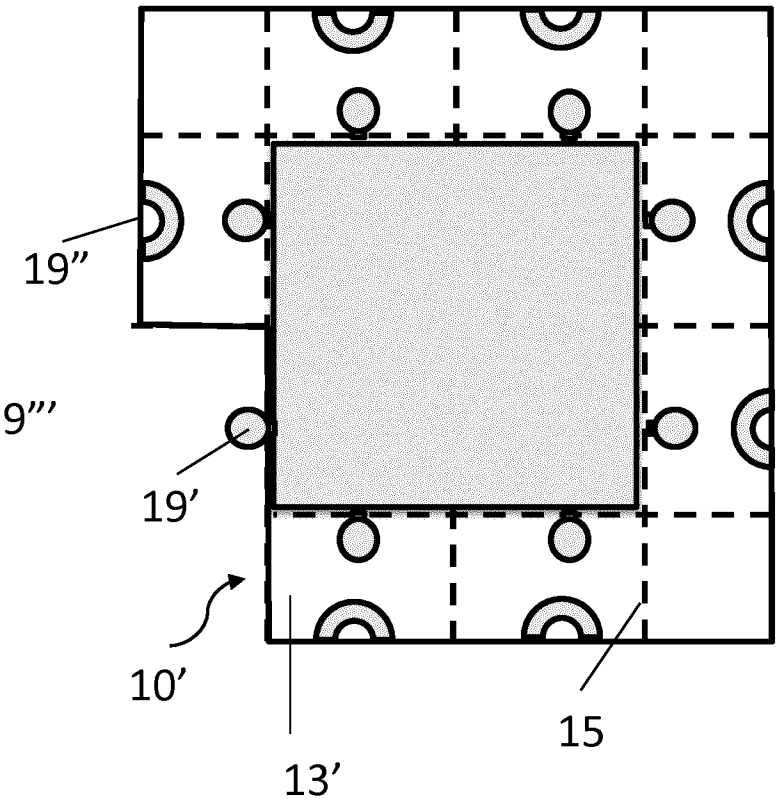
FIG. 4B shows a view from beneath (facing the light output face) of a schematic embodiment of a corresponding further luminaire.
Figure 4A:
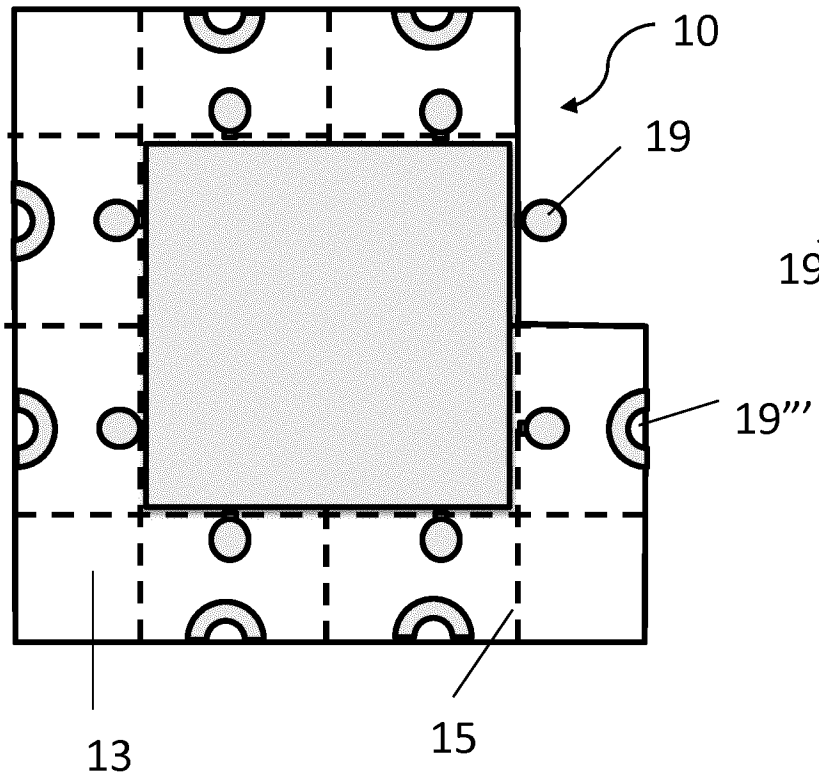
FIG. 4A shows a view from beneath (facing the light output face) of a schematic embodiment of a further luminaire.

FIG. 4A shows a view from beneath (facing the light output face) of a schematic embodiment of a further luminaire 10. In this example, it can be seen that the male mechanical connection elements 19 are located on the side wall of the square cross-sectioned housing 1 whilst the female mechanical connection elements 19''' are part of the radially extending first flange 13. The embodiment also shows that more cutting lines are possible, this allows for a more discrete removal of portions 13*a* from the radially extending flange 13.

FIG. 4B shows a view from beneath (facing the light output face) of a schematic embodiment of a corresponding further luminaire 10'. In this example, it can be seen that the male mechanical connection elements 19' are located on the side wall of the square cross-sectioned housing 1' whilst the female mechanical connection elements 19'' are part of the radially extending second flange 13'. The embodiment also shows that more cutting lines are possible, this allows for a more discrete removal of portions 13*a* from the radially extending flange 13'. This may facilitate a more aesthetically pleasing appearance or it may increase the mechanical strength of the connection between the first luminaire 10 and the second luminaire 10'' when creating a lighting system 100.

Figures 5A, 5B:
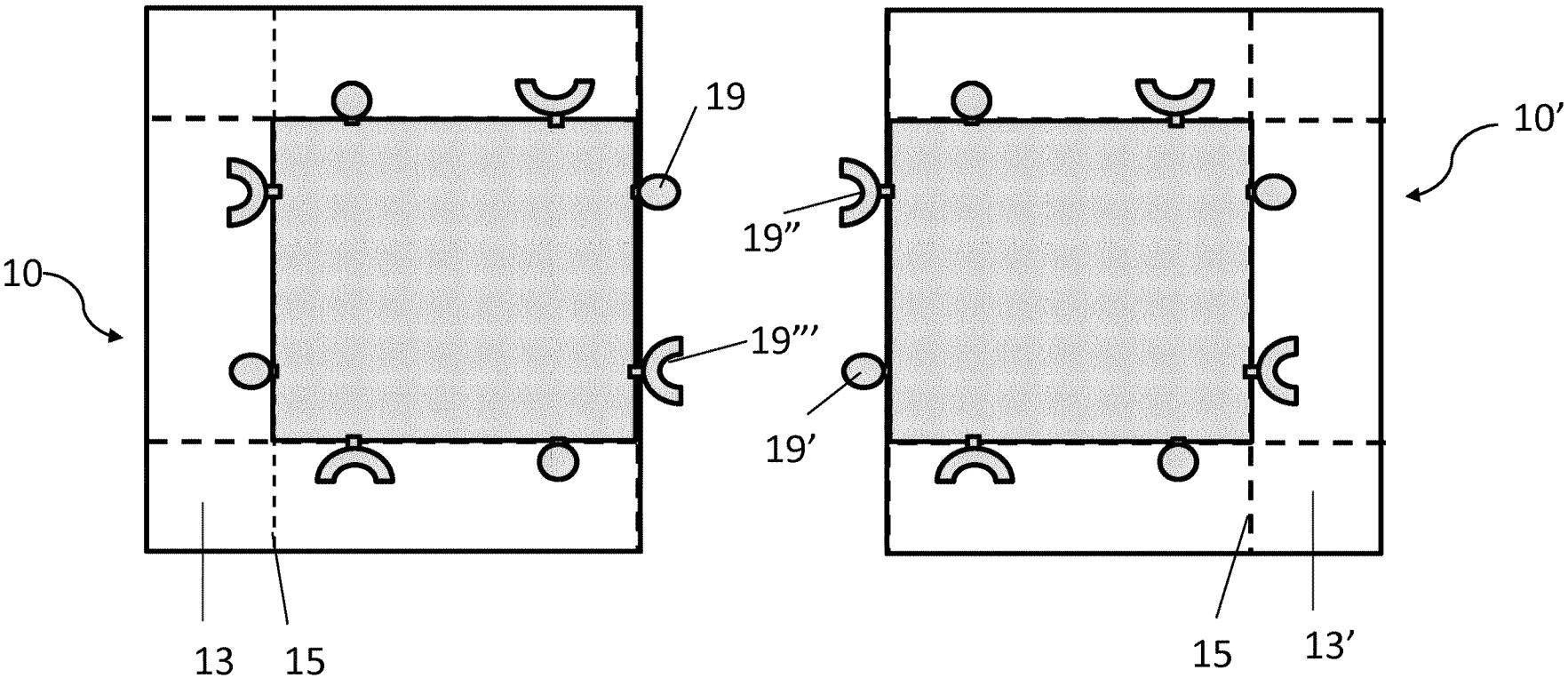
FIG. 5A shows a view from beneath (facing the light output face) of a schematic embodiment of a further luminaire.
FIG. 5B shows a view from beneath (facing the light output face) of a schematic embodiment of a corresponding further luminaire.

FIG. 5A shows a view from beneath (facing the light output face) of a schematic embodiment of a further luminaire 10. In this embodiment, the cutting lines 15 are adjacent and parallel to the side of the annular wall of the housing 1. The annular wall further comprises a male mechanical connector element 19 and a female mechanical connector element 19''' per side (i.e., four pairs of mechanical connector elements per luminaire housing 10).

FIG. 5B shows a view from beneath (facing the light output face) of a schematic embodiment of a corresponding further luminaire 10'. In this figure, the cutting lines 15 are adjacent and parallel to the side of the annular wall of the housing 1'. The annular wall further comprises a male mechanical connector element 19' and a female mechanical connector element 19'' per side (i.e., four pairs of mechanical connector elements per luminaire housing 10'). These removed portions of the first radially extending flange 13 of the first luminaire 10 and the second radially extending flange 13' of the second luminaire 10' as well as the annular walls comprising the mechanical connector elements 19, 19', 19'' & 19''' means that when a modular lighting system 100 is constructed from these two coopering luminaires 10 & 10' there will be no portions of the radially extending flanges 13 or 13' between the two luminaires 10 & 10'. This may result in a more aesthetically appealing lighting system, or may allow a lighting system to be located in a smaller location.

Figure 6B:
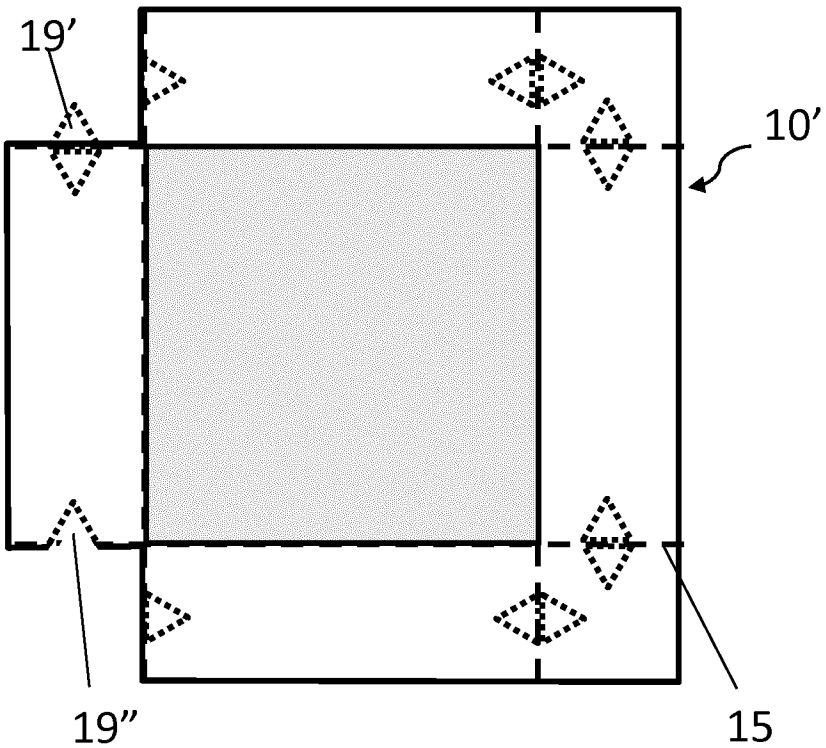
FIG. 6B shows a view from beneath (facing the light output face) of a schematic embodiment of a corresponding further luminaire.
Figure 6A:
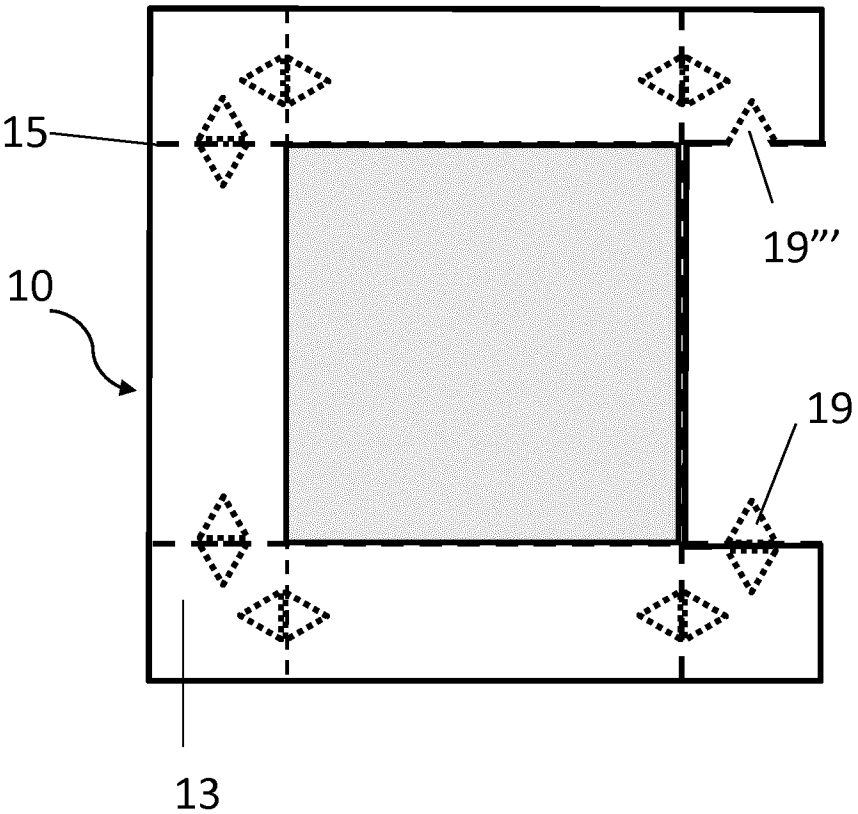
FIG. 6A shows a view from beneath (facing the light output face) of a schematic embodiment of a further luminaire.

FIG. 6A shows a view from beneath (facing the light output face) of a schematic embodiment of a further luminaire 10. In this embodiment, the cutting lines 15 are adjacent and parallel to the sides of the polygonal annular wall. There are no mechanical connector elements located on the annular wall, in this embodiment there are located on the radially extending flange 13. The mechanical connector elements 19 & 19''' are preferably part of the cutting lines 15, i.e., the form the mechanical elements when the region is removed from the radially extending flange 13.

FIG. 6B shows a view from beneath (facing the light output face) of a schematic embodiment of a corresponding further luminaire 10'. As already discussed in relation to FIG. 6A, the male connector element 19' and the female mechanical connector elements 19'' are formed in the radially extending flange 13'' of luminaire 10' when a portion is removed from the radially extending flange when cut along the demarcated cutting lines 15. This may remove additional material from the housing and may also simply the mold used for manufacturing the housings, both of these advantages may reduce the cost of the finished product.

Figure 7B:
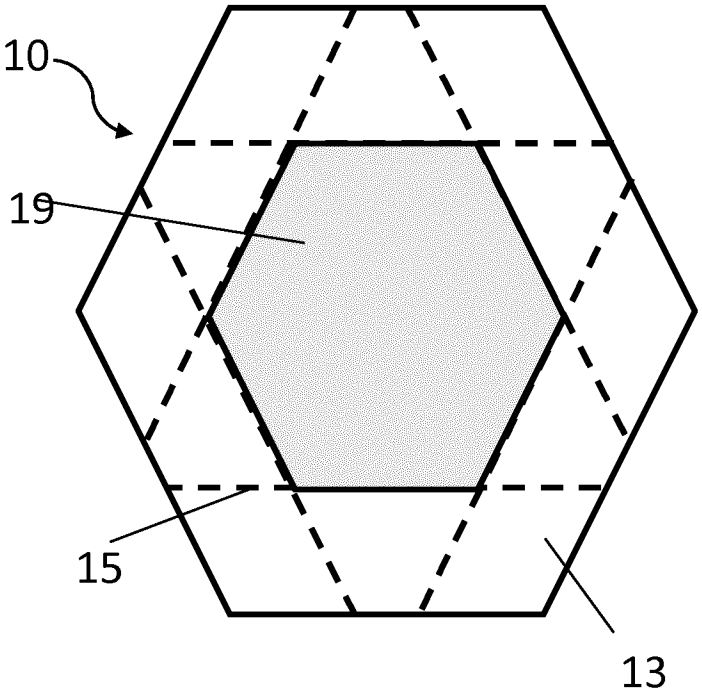
FIG. 7B shows a view from beneath of a schematic embodiment of a further luminaire.
Figure 7A:
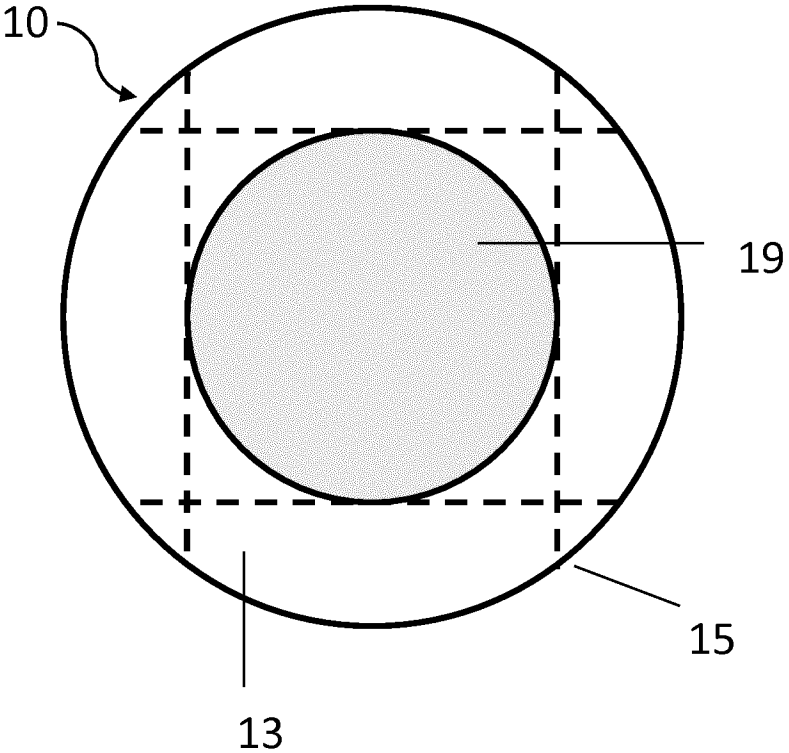
FIG. 7A shows a view from beneath of a schematic embodiment of a further luminaire.

FIG. 7A shows a view from beneath of a schematic embodiment of a further luminaire 10. In this embodiment, the luminaire 10 has a circular cross-section orthogonal to the central axis of the luminaire. In the figure, the radially extending flange 13 has 4 cutting lines 15 but any number of lines could be used. If the circular luminaire 10 has a greater number of cutting lines 15, more discrete regions may be removed from the radially extending flange 13 thus allowing more varied modular lighting systems 100 (shown in more detail in FIGS. 9A and 9B.

FIG. 7B shows a view from beneath of a schematic embodiment of a further luminaire 10. In this figure, the luminaire 10 has a hexagonal cross-section orthogonal to the central axis of the housing 1. An advantage of using luminaires 10, 10', 10'', 10''' etc. having polygonal, preferably, regular polygonal cross-sectioned housings, 1, 1', 1'', & 1''' etc., is the fact that they tessellate readily to offer a densely packed modular lighting system 100. If each face of the polygonal annular wall has an associated cutting line that extends fully across the radially extending flange 13, then the following equation is applicable:

wherein the polygonal shape has n No. of sides then the flange is divided into 2*n removable portions by n No. of cutting lines.

Figure 8B:
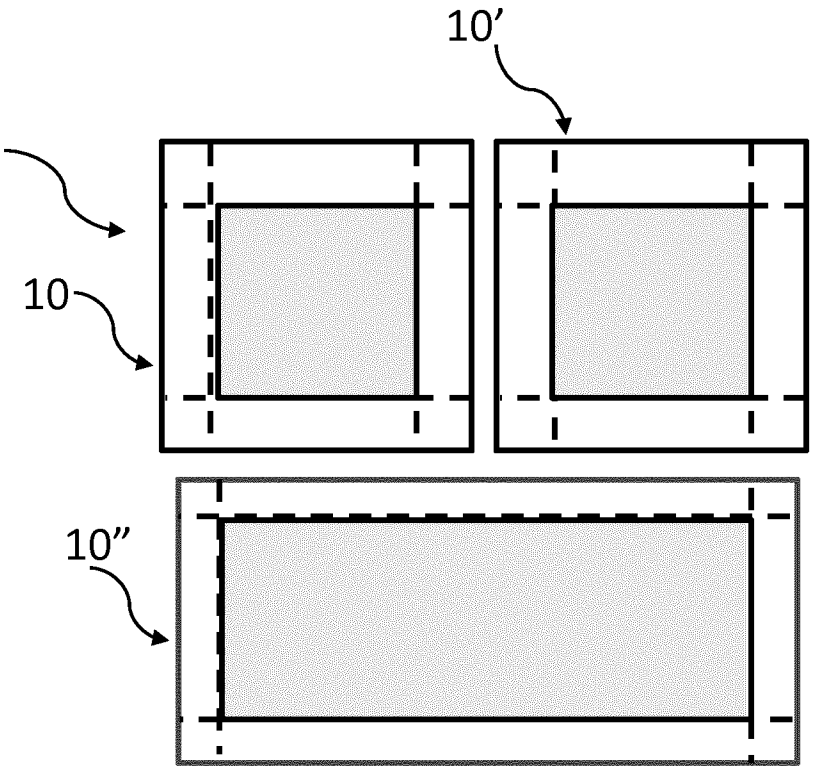
FIG. 8B shows a view from beneath of a schematic embodiment of a lighting system comprising a housing/luminaire group.
Figure 8A:
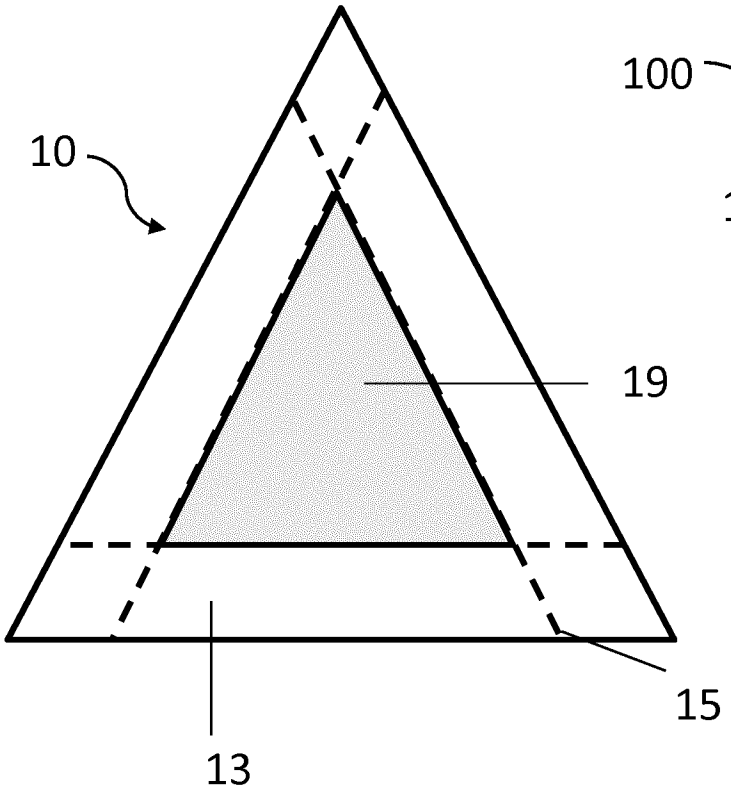
FIG. 8A shows a view from beneath of a schematic embodiment of a further luminaire.

FIG. 8A shows a view from beneath of a schematic embodiment of a further luminaire 10. In this figure, a luminaire having an equilateral triangular cross-section orthogonal to the central axis of the housing 1 is shown. As it is a regular polygonal shape with each face of the annular wall having an associated cutting edge, the above equation is also applicable.

FIG. 8B shows a view from beneath of a schematic embodiment of a lighting system 100 comprising a housing/luminaire group. In this figure, it is shown that it is not required that all luminaires 10, 10' & 10'' have the same cross-sectional shape. It is shown here that a rectangular luminaire 10'' can be connected to two square shaped luminaires 10 & 10'. This variation may be used to make modular lighting systems 100 from a combination of many cross-sectionally shaped luminaires 10, 10', 10'', 10''' etc. Indeed, so many combinations are possible that the installer has essentially a "free-hand" to construct a desired modular lighting system 100.

Figure 9B:
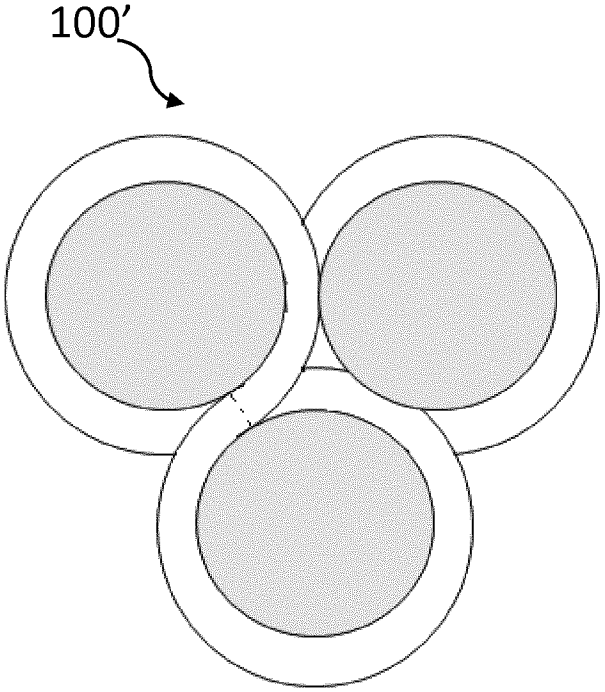
FIG. 9B shows a view from beneath of a schematic embodiment of a further lighting system comprising a further housing/luminaire group.
Figure 9A:
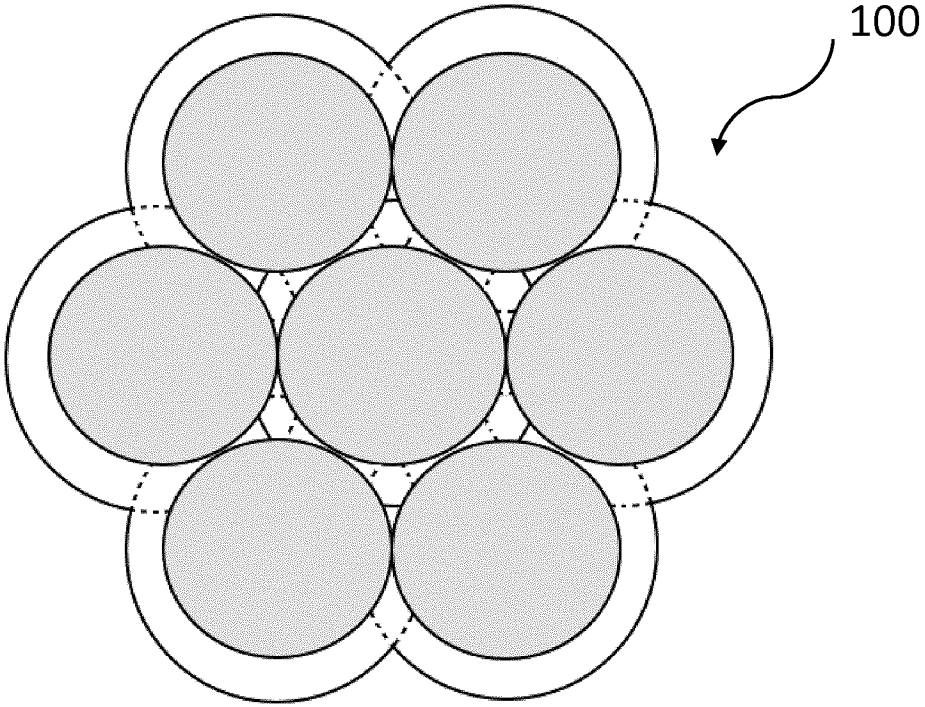
FIG. 9A shows a view from beneath of a schematic embodiment of a further lighting system comprising a further housing/luminaire group.

FIG. 9A shows a view from beneath of a schematic embodiment of a further lighting system 100 comprising a further housing/luminaire group. In this figure, a hexagonally-packed circular array is shown.

FIG. 9B shows a view from beneath of a schematic embodiment of a further lighting system 100' comprising a further housing/luminaire group. In this figure, an array of circular luminaires is shown, the cutting lines of the radially extending flange can be provided in such a way that the finished lighting system 100' has a decorative visible flange pattern created when the luminaires are connected together.

Figure 10B:
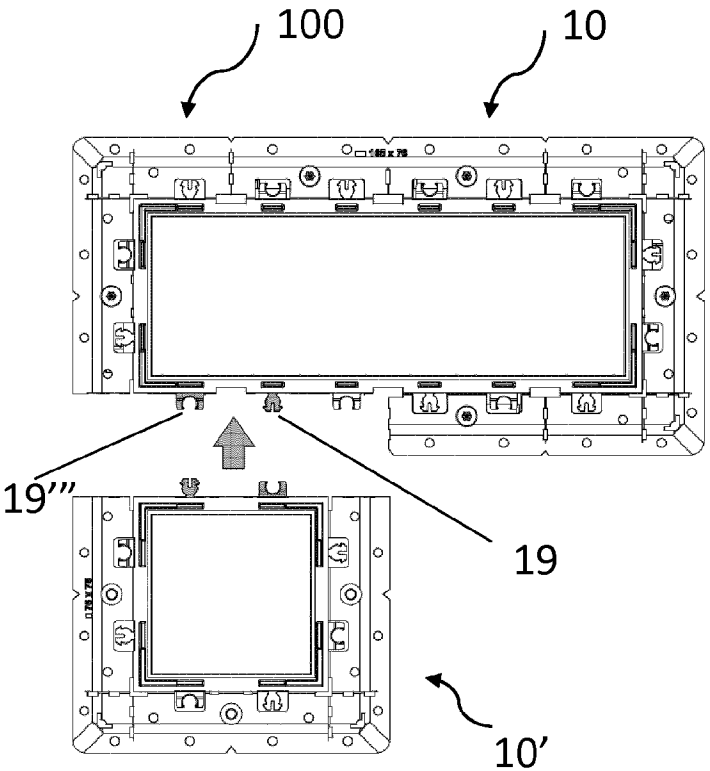
FIG. 10B shows a view from beneath of an embodiment of a further lighting system comprising a further housing/luminaire group.
Figure 10A:
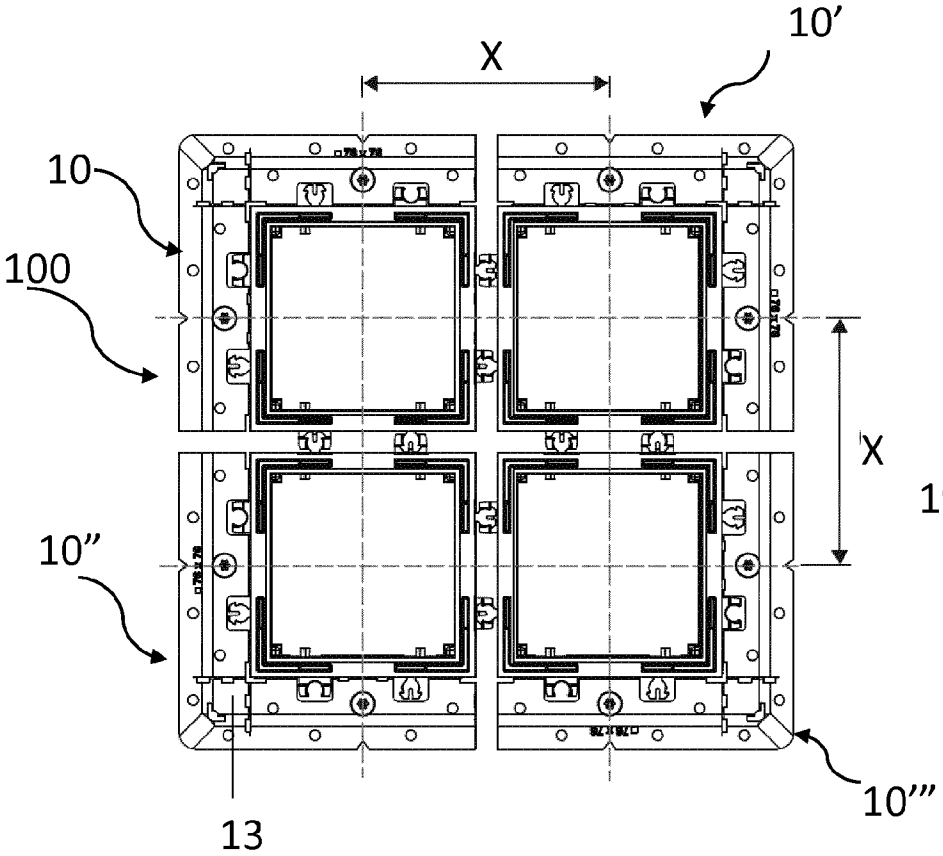
FIG. 10A shows a view from beneath of an embodiment of a further lighting system comprising a further housing/luminaire group.

FIG. 10A shows a view from beneath of an embodiment of a further lighting system 100 comprising a further housing/luminaire group, created from 4 square cross-section luminaires 10, 10', 10" & 10'". The radially extending flanges 13 have two portions (adjacent to each other) removed to allow a close-coupled square lighting system that accommodates 4 lighting units to be created. In this instance, close-coupled is taken to mean a lighting system having a pitch X (distance between adjacent luminaire's central axes) that is smaller than an equivalent lighting system wherein the radially extending flanges 13 are not entirely removed between adjacent, connected luminaires 10, 10', 10" & 10'" (as shown in FIG. 11).

FIG. 10B shows a view from beneath of an embodiment of a further lighting system 100 comprising a further housing/luminaire group, this embodiment is similar to that shown in FIG. 8B. A rectangular cross-sectioned luminaire 10 is mechanically connected using male and female connectors 19, 19'", 19" and 19' (the last two not shown in the interest of clarity) to a square cross-sectioned luminaire 10". As discussed in relation to FIG. 10A, this lighting system 100 has a relatively small pitch distance X between central axes of adjacent luminaires 10 & 10'.

Figure 11A:
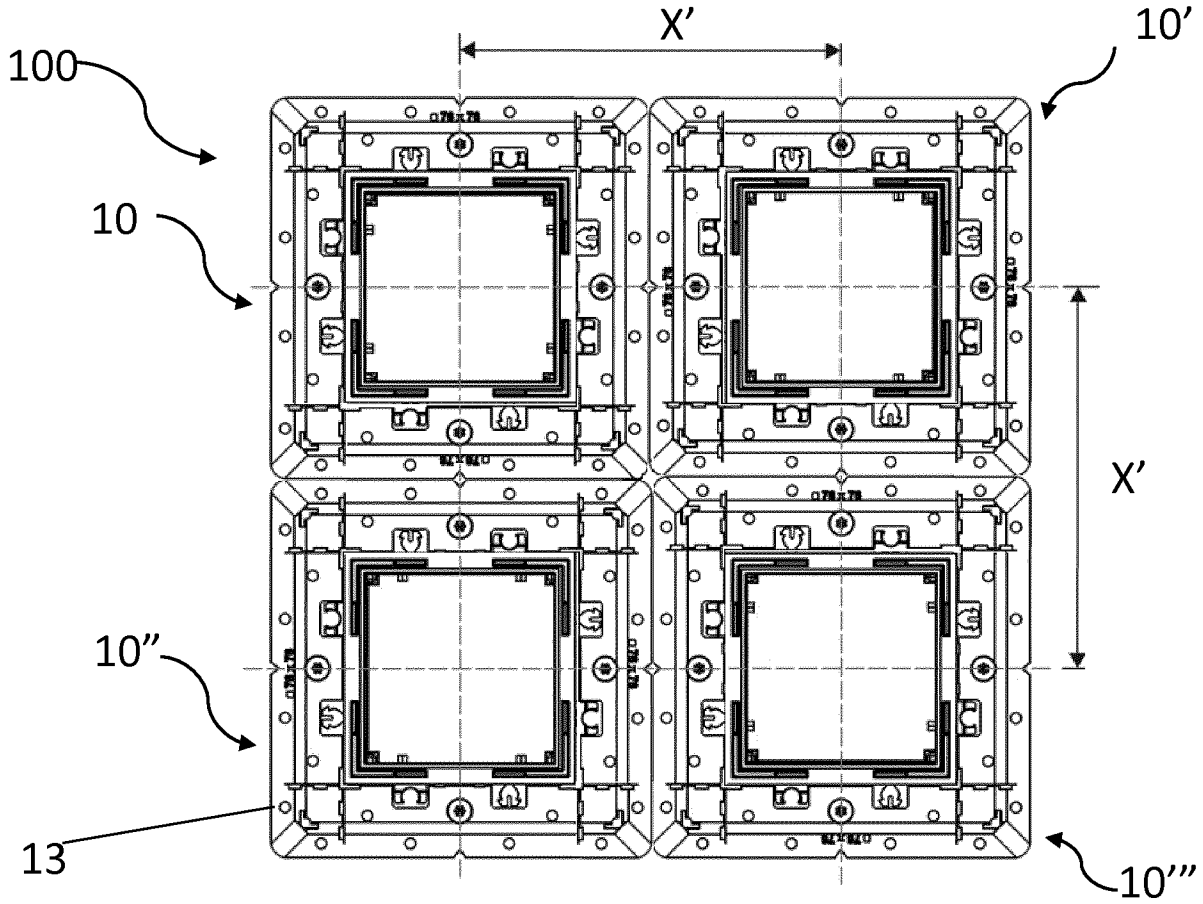
FIG. 11A shows a view from beneath of an embodiment of a further lighting system comprising a further housing/luminaire group.

FIG. 11A shows a view from beneath of an embodiment of a further lighting system 100 comprising a further housing/luminaire group. In this figure, a portion of the radially extending flanges 13 remains between adjacent, connected luminaires 10, 10', 10" & 10'". The pitch distance X in this case will be greater for lighting system 100 comprising luminaires 10, 10', 10" & 10'" with at least a portion of the radially extending flanges 13 remaining compared to a lighting system 100 comprising identically sized luminaires 10, 10', 10" & 10'" wherein the entire portion of the radially extending flanges 13 between the adjacent connected luminaires 10, 10', 10" & 10'" are removed.

Figure 11B:
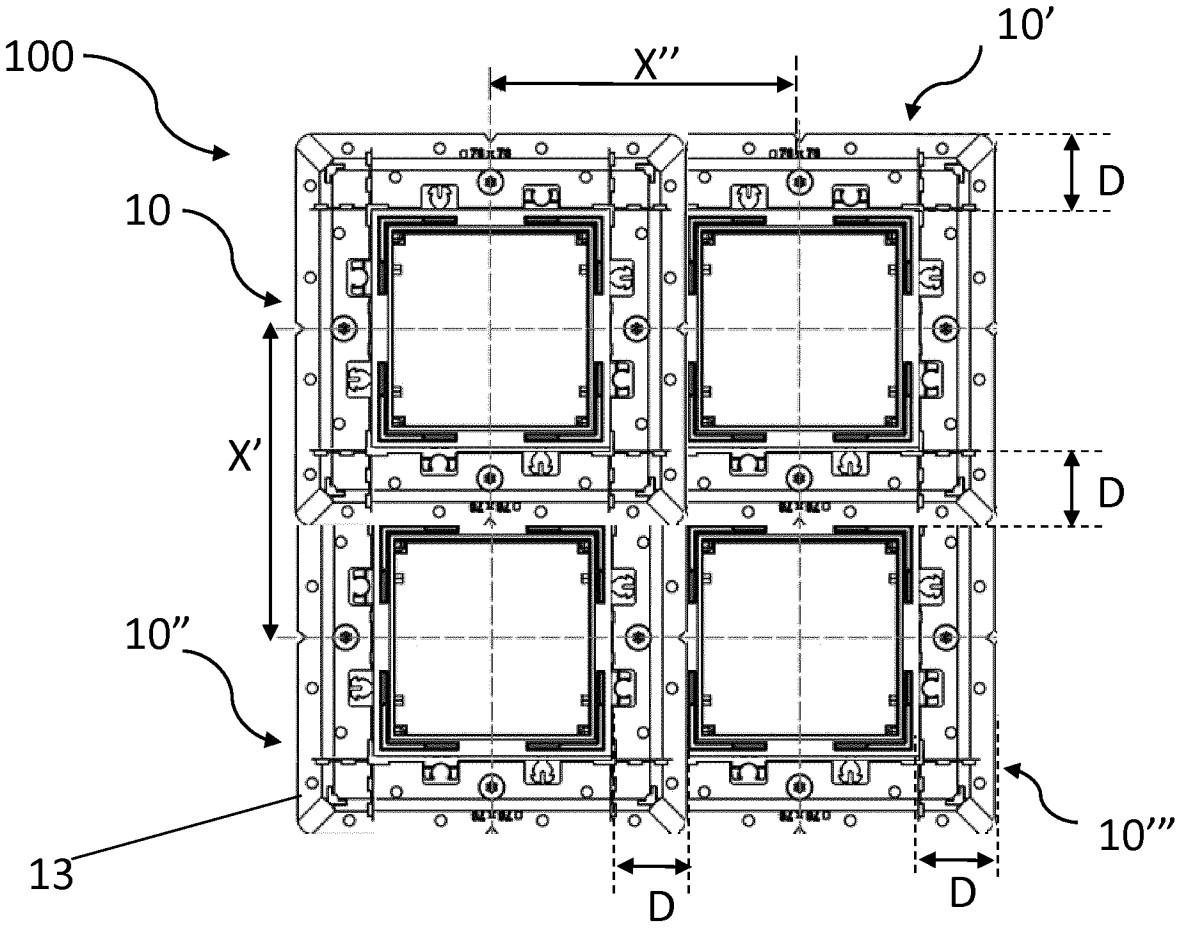
FIG. 11B shows a view from beneath of an embodiment of a further lighting system comprising a further housing/luminaire group.

FIG. 11B shows a view from beneath of an embodiment of a further lighting system 100 comprising a further housing/luminaire group, in this figure, a portion of the radially extending flanges 13 remain between adjacent, connected luminaires 10, 10", 10" & 10'". However, unlike previous embodiments, the flange remains intact on one of the luminaires per pair of luminaires, i.e., between 10 & 10" between 10 & 10', between 10" &10'" & between 10" & 10'". This results in a distance D between the annular wall on connected luminaires and leads to a greater pitch distance X than in the case of FIG. 10A but less than shown in FIG. 11A.

Figure 11C:
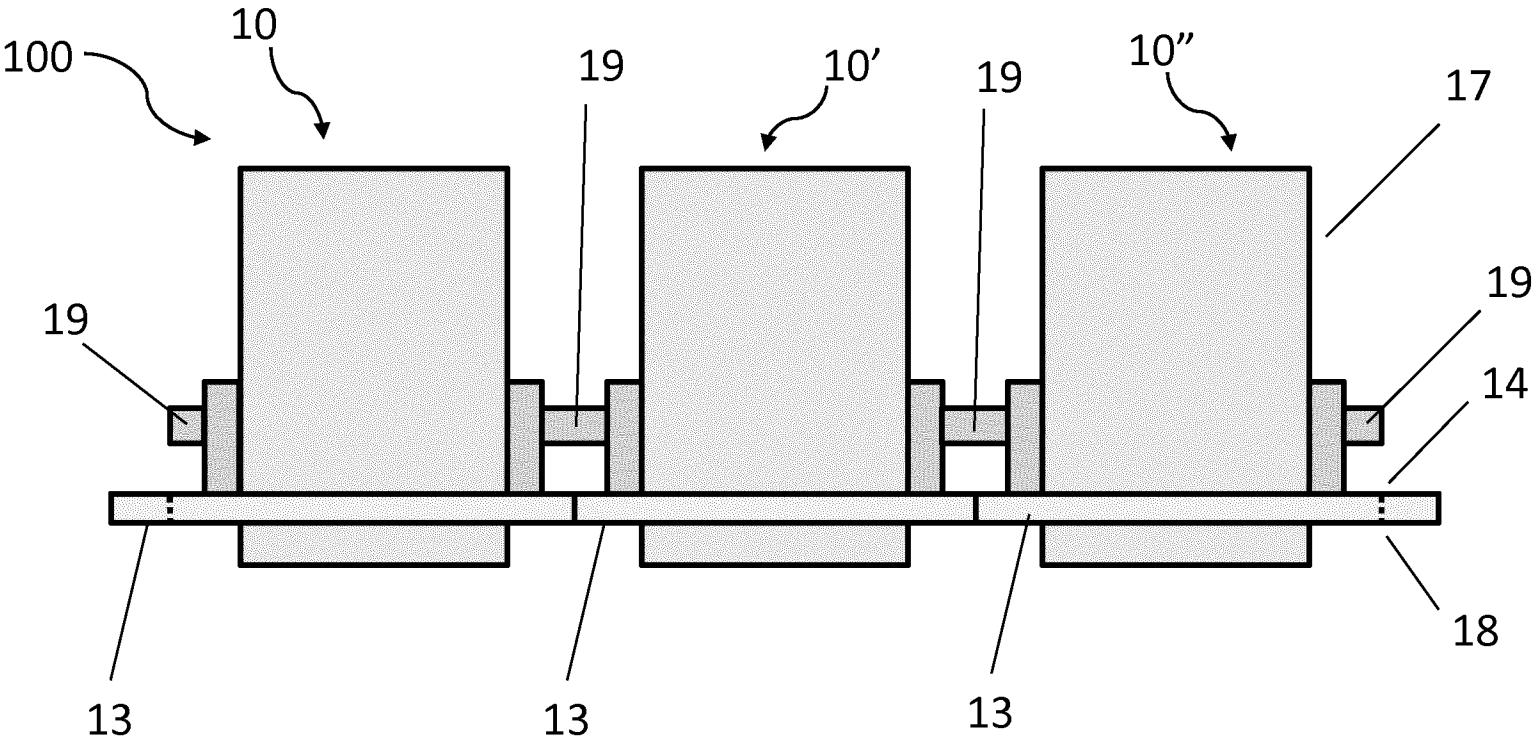
FIG. 11C shows a cross section side view of a lighting system comprising a housing/luminaire group of three connected luminaires in a linear arrangement.

FIG. 11C shows a cross section side view of a lighting system 100 comprising a housing/luminaire group of three connected luminaires 10, 10" & 10" in a linear arrangement. The annular wall 17 of the luminaire 10" can be seen extending from the radially extending flange 13. It can also be see that the annular wall 17 not only extends from the main face 14 of the radially extending flange 13 but it also extends from the second main face 18 of the radially extending flange 13. There are mechanical connector elements 19 between the adjacent connected luminaires 10, 10' & 10'" in order to allow the linear arrangement to be constructed. As shown, a lighting unit 23 is insertable alongside the axis 12 into the cavity of the housing of the respective luminaire.

Figure 12:
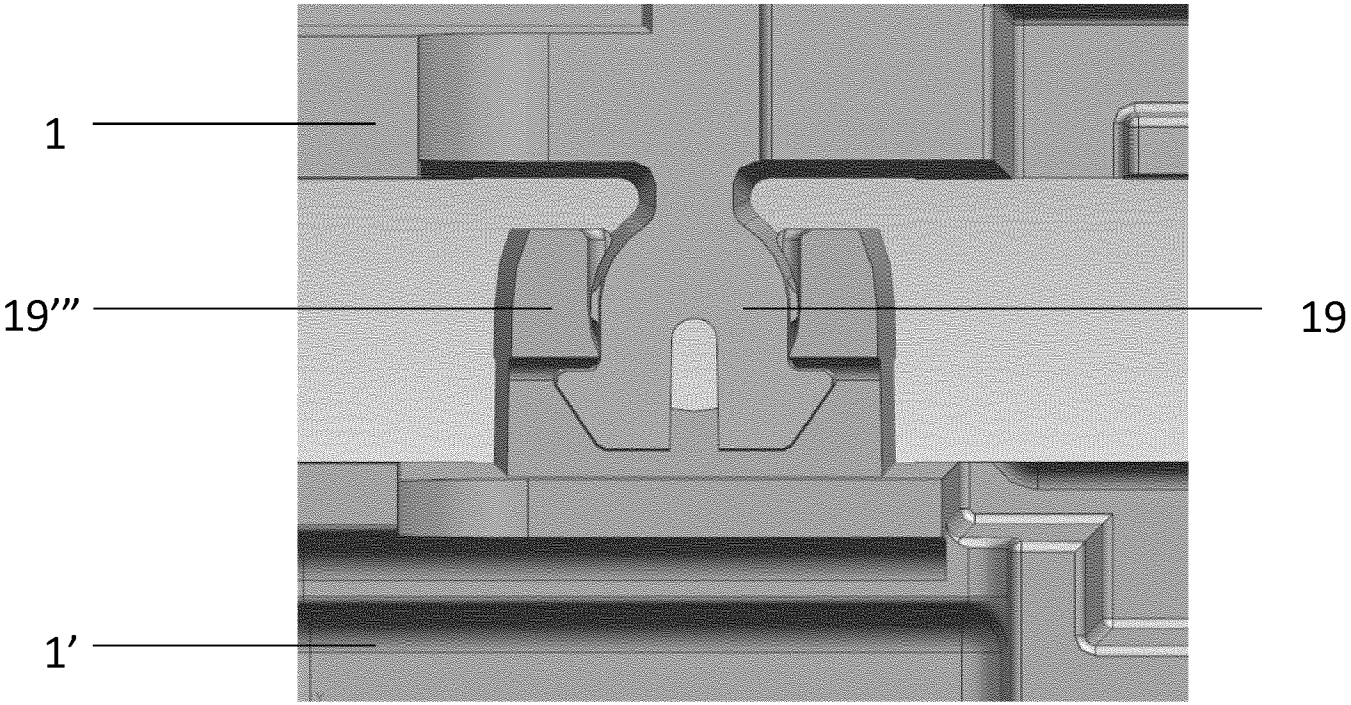
FIG. 12 shows a close-up view of an embodiment of the at least one mechanical connector element.

FIG. 12 shows a close-up view of an embodiment of the at least one mechanical connector element 19 further comprising a male mechanical connector element 19, shown as part of housing 1 and female mechanical connector element 19'" shown as part of further housing 1". These type of mechanical connector elements, may "snap together" if pressed together in a radial direction, alternatively, they may slide together if pressed together in an axial direction.

The invention claimed is:

1. A lighting system comprising a first luminaire and a second luminaire, each of the first and second luminaires comprising a housing and a lighting unit insertable into and removable from the housing, wherein the housing comprises a radially extending flange around an annular wall, the annular wall protruding in an axial direction around a central axis from a first main face of the radially extending flange, wherein the housing further comprises a clamping arrangement for clamping the housing to a carrier or substrate, the clamping arrangement being removable from the housing, wherein the first luminaire has a first radially extending flange with a first removable portion and the second luminaire has a second radially extending flange with a second removable portion, wherein after removal of said first removable portion and said second removable portion, said first and second radially extending flanges are connectable matching parts, which in mutually connected position form a shared flange.

2. The lighting system as claimed in claim 1, wherein the housing comprises multiple clamping arrangements, and wherein a first clamping arrangement alongside a face closest to the portion of the radially extending flange that is removable from the housing is removable.

3. The lighting system as claimed in claim 1, wherein the clamping arrangement is provided on a removable portion of the radially extending flange.

4. The lighting system as claimed in claim 1, wherein each of the first and second luminaires has a cross section orthogonal to the central axis, the cross section being one of a circle, ellipse, square, rectangle, triangle, hexagon or any other polygonal shape.

5. The lighting system as claimed in claim 1, wherein the radially extending flange comprises surface features or through-holes to demarcate at least one cutting line.

6. The lighting system as claimed in claim 5, wherein each of the first and second luminaires has a cross section orthogonal to the central axis, the cross section being a polygonal shape, and wherein each side of the polygonal shape has a respective cutting line extending adjacent and parallel to said side and over the full length of the radially extending flange at said respective side.

7. The lighting system as claimed in claim 6, wherein the polygonal shape has n sides, and wherein the radially extending flange is divided into 2*n removable portions by n cutting lines.

8. The lighting system as claimed in claim 1, wherein the annular wall (and/or the radially extending flange comprises a mechanical connector element.

9. The lighting system as claimed in claim 1, wherein the first radially extending flange, the second radially extending flange, and the shared flange have an equal width measured along a respective virtual line through a respective central axis and extending in a respective direction transverse to a respective annular wall.

10. A method of assembling the lighting system as claimed in claim 1, said method comprising the steps of:

removing a selected first portion of the first radially extending flange of the first luminaire, removing a selected first clamping arrangement from the first luminaire, removing a selected second portion of the second radially extending flange of the second luminaire, removing a selected clamping arrangement from the second luminaire, connecting the first luminaire and the second luminaire to form a luminaire group suitable for receiving a plurality of lighting units, and inserting a respective lighting unit of a plurality of lighting units in a respective housing of the luminaire group.

11. The method as claimed in claim 10, the method further comprising;

removing a selected further portion of a further radially extending flange from a further luminaire, removing a selected further clamping arrangement from the further luminaire, connecting the first luminaire, the second luminaire and the further luminaire to form the luminaire group.

12. The method as claimed in claim 10, the method further comprising:

mounting the plurality of luminaires to a substrate or carrier.

13. The method as claimed in claim 10, the method further comprising the additional prior steps of:

selecting a first luminaire having a first cross section orthogonal to its central axis, selecting a second luminaire having a second cross section orthogonal to its central axis, said second cross section being either equal or different in shape from the first cross section.

* * * * *